US005916387A

United States Patent [19]

Dannenberg et al.

[11] Patent Number: 5,916,387

[45] Date of Patent: Jun. 29, 1999

[54] METHOD OF REDUCING THE GAPING VALUES IN THE WEB SAW CUT TEST ON STEEL RAILWAY TRACKS

[75] Inventors: Robert Dannenberg, Issum; Herbert Schmedders, Essen; Jürgen Scharlack, Duisburg, all of Germany

[73] Assignee: Thyssen Stahl AG, Duisburg, Germany

[21] Appl. No.: 08/910,852

[22] Filed: Aug. 13, 1997

[30] Foreign Application Priority Data

Aug. 22, 1996 [DE] Germany ..... 196 33 758

[51] Int. Cl.[6] ..... C21D 9/04

[52] U.S. Cl. ..... 148/581; 148/639

[58] Field of Search ..... 148/581, 639

[56] References Cited

U.S. PATENT DOCUMENTS 3,525,326 8/1970 Deal .

FOREIGN PATENT DOCUMENTS

| | | | |
|---|---|---|---|
| 1288 620 | 2/1969 | Germany . | |
| 3501 522 C1 | 4/1986 | Germany . | |
| 3501 523 C1 | 4/1986 | Germany . | |
| 3638 816 C1 | 5/1988 | Germany . | |
| 13500 | 4/1971 | Japan | 148/581 |

*Primary Examiner*—Deborah Yee

*Attorney, Agent, or Firm*—Proskauer Rose LLP

[57] ABSTRACT

This invention concerns a method of reducing the gaping values of railway tracks made of steel to less than 3.6 mm. It is characteristic of this invention that the rolled and leveled rails are heated briefly, i.e., for approx. 10 to 25 sec, until reaching a maximum temperature of 100° C. in the rail head and a maximum of 260° C. in the web, and then they are allowed to cool again immediately.

5 Claims, No Drawings

METHOD OF REDUCING THE GAPING VALUES IN THE WEB SAW CUT TEST ON STEEL RAILWAY TRACKS

This invention concerns a method of reducing the gaping values in the web saw cut test on steel railway tracks to less than 3.6 mm.

BACKGROUND OF THE INVENTION

The web saw cut test is stipulated internationally for estimating the residual stress level of railway tracks made of steel. This test is performed by making a 450 mm long saw cut along the neutral axis in the web of a rail section of 1.20 m length. Then the vertical gaping value should not exceed 3.63 mm. The gaping value permits a quantification of the susceptibility of the tracks to web breaks.

It has been found that in the manufacture of railway tracks, the above-mentioned limit value cannot be maintained reliably, but instead it is exceeded occasionally. The object of this invention is to guarantee that the gaping values obtained will in any case be lower than the specified limit in traditional production of railway tracks, so as to comply with customer demand.

DESCRIPTION OF THE INVENTION

To achieve this object, it is proposed according to this invention that the rolled and leveled rails be heated briefly until reaching a maximum temperature of 100° C. in the rail head and a maximum of 260° C. in the web, and then be allowed to cool again directly. The heating should be brief and should not last longer than 25 sec, so that it can be carried out on-line following the levelling operation. At a levelling rate of 1 m/s, even a heating time of 10 sec would require the heating apparatus to be 10 m long. It is of course also fundamentally possible not to perform the heating to reduce the gaping value on-line but instead as a separate process outside the levelling machine.

Through the heating according to this invention, the rail head should be brought to a temperature of 40° C. to 70° C. and the rail web (axis of the center of gravity) should be brought to 100° C. to 250° C. Immediately after reaching this temperature profile in the rail, it is cooled directly in motionless air.

It has been found that a gaping value below the required limit of 3.63 mm could be guaranteed in the manufacture of railway track by brief heating of the rail to approx. 40° C. in the rail head and 150° C. in the rail web for a period of time on the order of 10 sec.

According to one embodiment of the method according to this invention, the tracks can be heated by means of burner gases which are directed at both sides of the rail approximately at the level of the axis of the center of gravity of the rail section. The burners can be operated with an oxygen-acetylene gas mixture, for example.

As an alternative to burner heating, the heating can also be accomplished by an electroinductive method. Uniform heating of the rail web is important, preferably simultaneous heating of the rail web from both sides.

By subsequent heating of the rolled and leveled rails as proposed according to this invention, an elevated compressive strain is achieved in the rail web. If this exceeds the plastic limit of the material of the rail, the result is a lower residual compressive stress or even a residual tensile stress in the rail web after cooling. This reduces the gaping value.

EXAMPLES

The tests were performed on 1 m long roller-leveled samples from the UIC 60 rail section in rail steel grade UIC 900 A. Heating after levelling the rails was performed with burners in line that were operated with an oxygen-propane gas mixture and were directed from opposite sides at the rail samples moving past the burners at the level of the axis of the center of gravity of the rail section. The distance from the burners to the rail web was 20 to 25 mm.

1) A reference sample without subsequent heating had a gaping value of 4.0 mm, i.e., a value above the allowed limit of 3.6 mm.
2) After heating from both sides for 6 seconds, a gaping value of 3.8 mm was measured, which was still unsatisfactory. The temperature at the rail head was 32° C.
3) A rail sample was heated on both sides for 10 sec according to this invention. Then the temperature at the rail head was 40° C. The gaping value was measured as 3.4 mm.
4) A sample was heated for 15 sec. The temperature in the rail head rose to 47° C. The gaping value was then reduced to 2.8 mm.
5) After a heating time of 25 seconds, which resulted in heating to 200° C. in the rail web, a gaping value of 1.85 mm was measured on another rail sample heated according to this invention.
6) Another sample had a gaping value of 1.4 mm after heating for 35 sec with a burner spacing of 50 mm, which resulted in a temperature of 70° C. in the rail head and 250° C. in the web.

In each test, wire strain gauges are placed on the head and foot of the rail sample in the longitudinal direction of the rail. These wire strain gauges show the strain and compression during and after heating. No permanent curvature could be detected after cooling on the basis of the measurement signals from these wire strain gauges.

We claim:

1. A method of reducing the gaping values in the web saw cut test of railway tracks made of steel to less than 3.6 mm, comprising heating rolled and leveled rails briefly until a temperature of 40° C. to 70° C. is reached in the rail head and a temperature of 100° C. to 250° C. is achieved in the rail web, and immediately thereafter allowing said rails to cool.

2. The method of claim 1 wherein said rails are heated for a maximum of 25 seconds.

3. The method of claim 1 wherein said rails are heated by means of burner gases that are directed at opposite sides of said rails approximately at the level of the axis of the center of gravity of the rail section.

4. The method of claim 1 wherein said rails are heated by an electroinductive method.

5. The method of claim 1 wherein said rails are heated and cooled on-line immediately after being leveled.

* * * * *